US005916322A

United States Patent [19]

Venäläinen

[11] Patent Number: 5,916,322

[45] Date of Patent: Jun. 29, 1999

[54] POSITIONING DEVICE

[75] Inventor: Olavi Venäläinen, Kuopio, Finland

[73] Assignee: Autorobot Finland OY, Kuopio, Finland

[21] Appl. No.: 09/047,517

[22] Filed: Mar. 25, 1998

Related U.S. Application Data

[63] Continuation of application No. PCT/FI96/00495, Sep. 19, 1996.

[30] Foreign Application Priority Data

Sep. 26, 1995 [FI] Finland ..... 954547

[51] Int. Cl.[6] ..... B21J 13/08

[52] U.S. Cl. ..... 72/457; 72/705; 72/481.1; 72/481.5

[58] Field of Search ..... 72/705, 455, 457, 72/479, 480, 481.1, 481.5

[56] References Cited

U.S. PATENT DOCUMENTS

| | | | |
|---|---|---|---|
| 3,776,022 | 12/1973 | Lionello . | |
| 4,400,969 | 8/1983 | Specktor | 72/457 |
| 4,530,232 | 7/1985 | Smith . | |
| 4,848,130 | 7/1989 | Jimenez . | |
| 5,016,464 | 5/1991 | Tomelleri | 72/705 |
| 5,596,900 | 1/1997 | Pietrelli | 72/705 |
| 5,644,946 | 7/1997 | Weschler | 72/457 |

FOREIGN PATENT DOCUMENTS

| | | |
|---|---|---|
| 2 132 021 | 2/1972 | Germany . |
| 347 668 | 4/1969 | Sweden . |
| 338 753 | 11/1970 | Sweden . |

*Primary Examiner*—Joseph J. Hail, III
*Assistant Examiner*—Ed Tolan
*Attorney, Agent, or Firm*—Pillsbury Madison & Sutro LLP

[57] ABSTRACT

The present invention relates to a positioning device for a tool. The positioning device comprises a mounting member (2) and a base frame (3), both detachably attached and lockable to a support (1) located close to the work object. The base frame incorporates a turning member (5) rotatably attached to the mounting member (2), and an arm (6) on which the tool (4) can also rotatably be installed. The arm (6) is attached into the turning member (5) so that the arm can be moved lengthwise, and locking members (8) are incorporated for mounting the arm 96) into the turning member (5).

6 Claims, 5 Drawing Sheets

POSITIONING DEVICE

This is a Continuation of International Appln. No. PCT/FI96/00495 filed Sep. 19, 1996 which designated the U.S.

BACKGROUND OF THE INVENTION

1. Field of the Invention

The present invention relates to a positioning device for a tool, and especially for a tool necessary in automotive bodyshell straightening, said device comprising a mounting member and a base frame both detachably attached and lockable to a support located close to the work object, the base frame incorporating a turnable member rotatably attached to the mounting member, and an arm on which the tool can also rotatably be installed.

2. Description of Background Information

Vehicle bodyshells and frames are aligned with the help of straightening systems, which straighten the damaged automotive vehicles and bring them again in a driving condition. With the conventional vehicle straightening systems it is difficult to extend the pulling or pushing tool to the different vehicle parts, to lock it in place or to create an efficient pull and/or push and/or support effect in the best possible way during the vehicle bodyshell straightening work. There are several different straightening devices available, which are used with vehicle straightening systems, but usually these are complicated and expensive. Another disadvantage often encountered is a slower and less efficient positioning of the tools in the different vehicle parts and a less solid mounting of the device in place. The same problem also affects many other industrial work applications.

It is an object of the present invention to provide a tool positioning device, which eliminates the problems connected with the existing devices. The special object of the invention is to present a positioning device, with the help of which it is easy to extend the tool to the desired point and to use it efficiently. Furthermore, it is another object of the invention to provide a positioning device of simple construction, which can be manufactured and used at a low cost, and which can be reliably locked. It is moreover an object of the invention to present a device usable with vehicle mounting, support and straightening.

SUMMARY OF THE INVENTION

The set goal is attained by a positioning device, characterized by the features defined in the patent claims.

The positioning device according to the invention provides an arm movable lengthwise attached to the turning member, and incorporates locking members for mounting the arm into the turning member. In this device it is firstly possible to turn the base frame in different directions relative to the support. The arm is additionally movable lengthwise relative to the turning member, and when the tool can moreover be turned relative to the arm, the tool situating at the end of the arm can be attached in the exactly right place in the work object, e.g. in the vehicle frame. The device is simple in construction, it can be produced with low costs and it is easy to use. The locking in the different embodiments of the invention can be provided in an earlier known way e.g. with the help of screw, pin, toothing, friction or cone locking methods.

In a further embodiment of the invention another lengthwise adjustable and lockable arm, where the tool is attached, is mounted onto the first arm. With this kind of arms the tool can be adjusted precisely in the desired place simply and quickly. The other arm is advantageously a pole-formed member rotatably attached to a support provided at the end of the first arm. When the second arm can also be adjusted by rotating it about its axle, the arms can be turned and adjusted exactly in the right place from the desired direction whereby the pull, push and supporting are performed precisely from the right direction. With the help of the device the vehicle can e.g. be mounted in the straightening system or supported during the straightening work, and additionally, the straightening tool can be installed and focused from the right direction.

In an advantageous additional embodiment of the invention, the positioning device incorporates locking members spaced at a distance for mounting the frame into the mounting member. The locking members situating at a distance from each other, a spotwise, efficient locking can be provided. Especially the locking screws create a spotwise locking, which also is efficient when the amount of the locking screws is sufficient.

In an other embodiment of the invention the device comprises a heightening arm which is attached onto the first arm and which extends upwards. With the help of the heightening arm the tool attached onto it reaches farther from the beam and the said tool can therefore be extended e.g. in the vehicle upper structures.

Moreover, the first arm incorporates adjusting and locking members which adjust the length of the second arm and focus the tool in place. E.g. adjusting and locking screws or hydraulic adjusting and operating apparatus can act as adjusting and locking instruments.

BRIEF DESCRIPTION OF THE DRAWINGS

An embodiment of the invention is next discussed in detail with the help of the attached drawings, in which.

DETAILED DESCRIPTION

Figure 1:
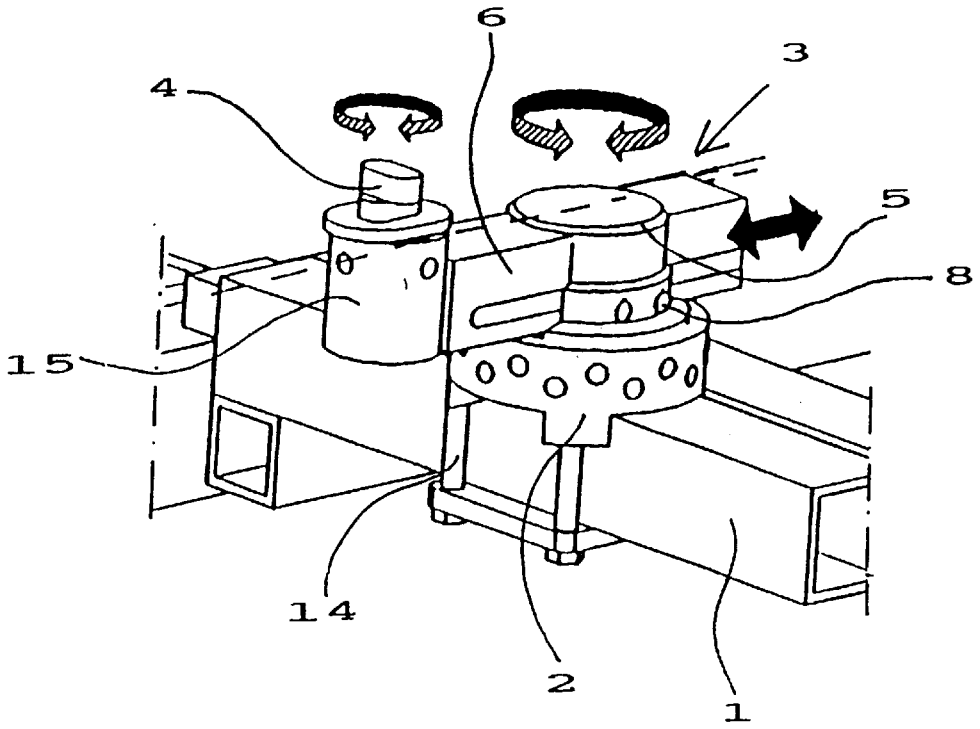
FIG. 1 shows in a side view an embodiment of the positioning device according to the invention attached to the beam of the vehicle straightening system.

In the application shown in FIG. 1, the positioning device comprises a mounting member 2 attachable to the beam 1 of the straightening system of the vehicle 12 and a frame 3 turnably attached to it. The frame 3 incorporates a turning member 5 turnably attachable to the mounting member and lenghtwise movable arm 6 attached to the turning member. The turning member 5 is attached to the mounting member 2 with the help of the locking members 9. The hole 20 is formed in the middle of the turning member and arm 6 is placed lenghtwise movably into this hole. In this embodiment the hole is mainly rectangular and the cross section has also corresponding rectangular shape. The device additionally comprises locking members 8 for attaching the arm to the turning member. The arm has lengthwise grooves, on which the locking members locate.

The mounting member 2 is a movable member on the beam I attached to its locking member beneath the beam with locking pins 14 and is tight enable firmly against the beam with the help of the locking pins and the locking member. The mounting member is round shaped and the turning member is lockable with the help of the locking members in desired position relative to the mounting member. This kind of mounting member is movable along the beam to the desired point with respect to the vehicle frame, which thus enables an easy positioning of the tool. The device is attachable to the lenghtwise or crosswise beam of the straightening system.

Figure 2:
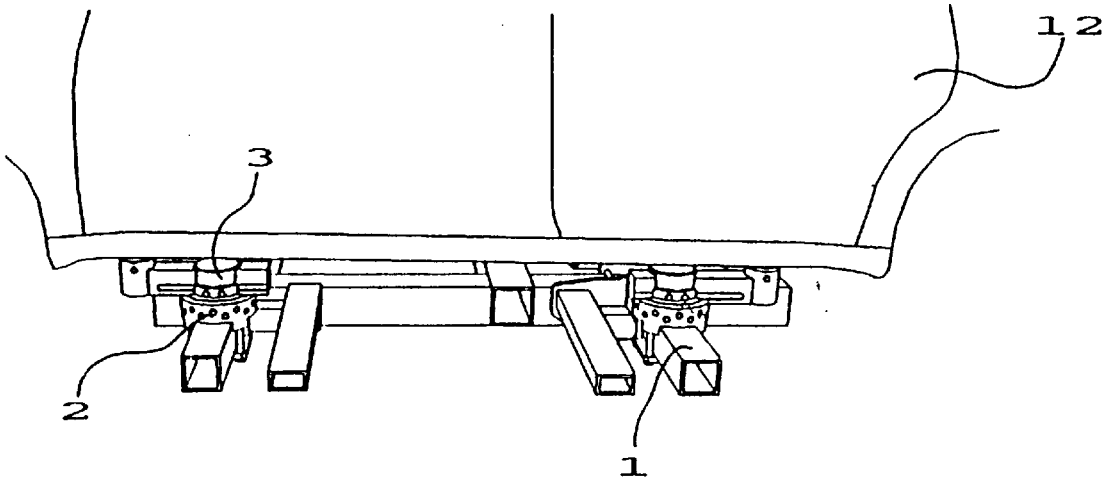
FIG. 2 shows in a side view the device illustrated in FIG. 1 attached to the beam of the straightening system.

The fastener 15, to which the tool 4 is attached turnably, is placed at the end of the arm 6. The tool is lockable with the help of locking members located on the sides of the fastener in desired position. In the application shown in FIG. 2 the vehicle is attached to the straightening system with two devices according to the invention.

Figure 3:
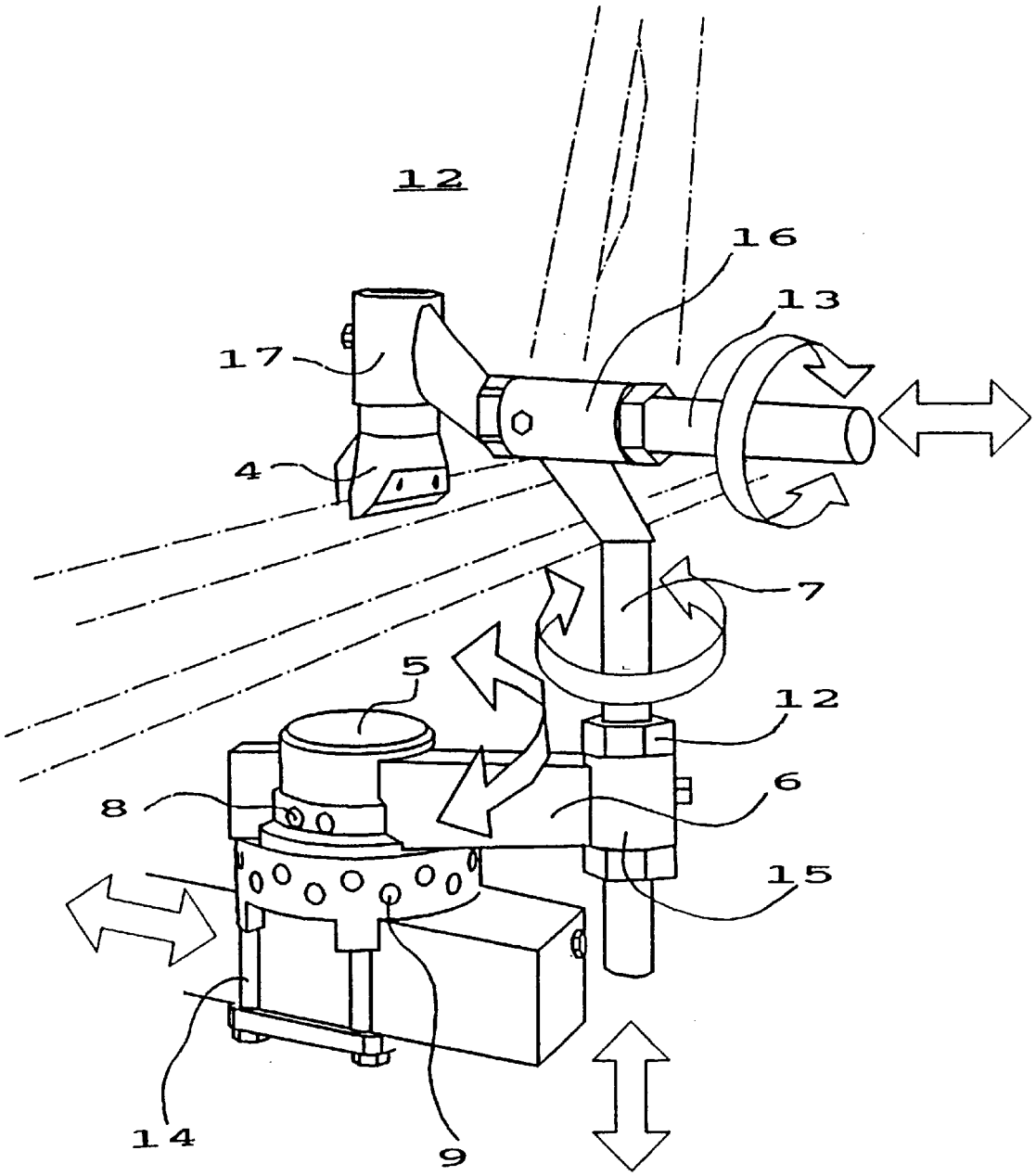
FIGS. 3 and 4 show a second and a third embodiment of the device according to the invention attached to the straightening system.

In the application shown in FIG. 3 the construction of the device corresponds to one shown in FIG. 1, but another arm 7 is attached to the fastener 15 located at the end of the arm 6, the said arm extending at right angles with respect to the arm 6, in other words it is in vertical direction with the respect to the straightening system and the beam. In this application the locking nuts function as locking members 12 of the arm. The arm 7 is a bar and is turnable about its axle i.e. is rotatable round the fastener 15.

Another fastener 16 is attached to the end of the arm 7 and a third arm 13 is attached to this fastener. The fastener 16 is situated crosswise at the end of the arm 7 and thus the arm 13 is at right angles with respect to the other arm 7. Also arm 13 is a bar and rotatable with respect to its fasteners. Additionally, the device comprises adjustment and mounting members to adjust and lock the arm member with respect to fastener 16.

A third fastener 17 is located in the end of the arm 13, to which an earlier-known clamping member 4 is attached, said clamping member being attachable to the frame of the vehicle 12. The clamping member 4 is attached rotatably to the fastener 17. The clamping member is attachable to extend either downward or upward from the fastener, and thus the device is also adjustable in this way and the clamping member can be set to a desired location.

Figure 4:
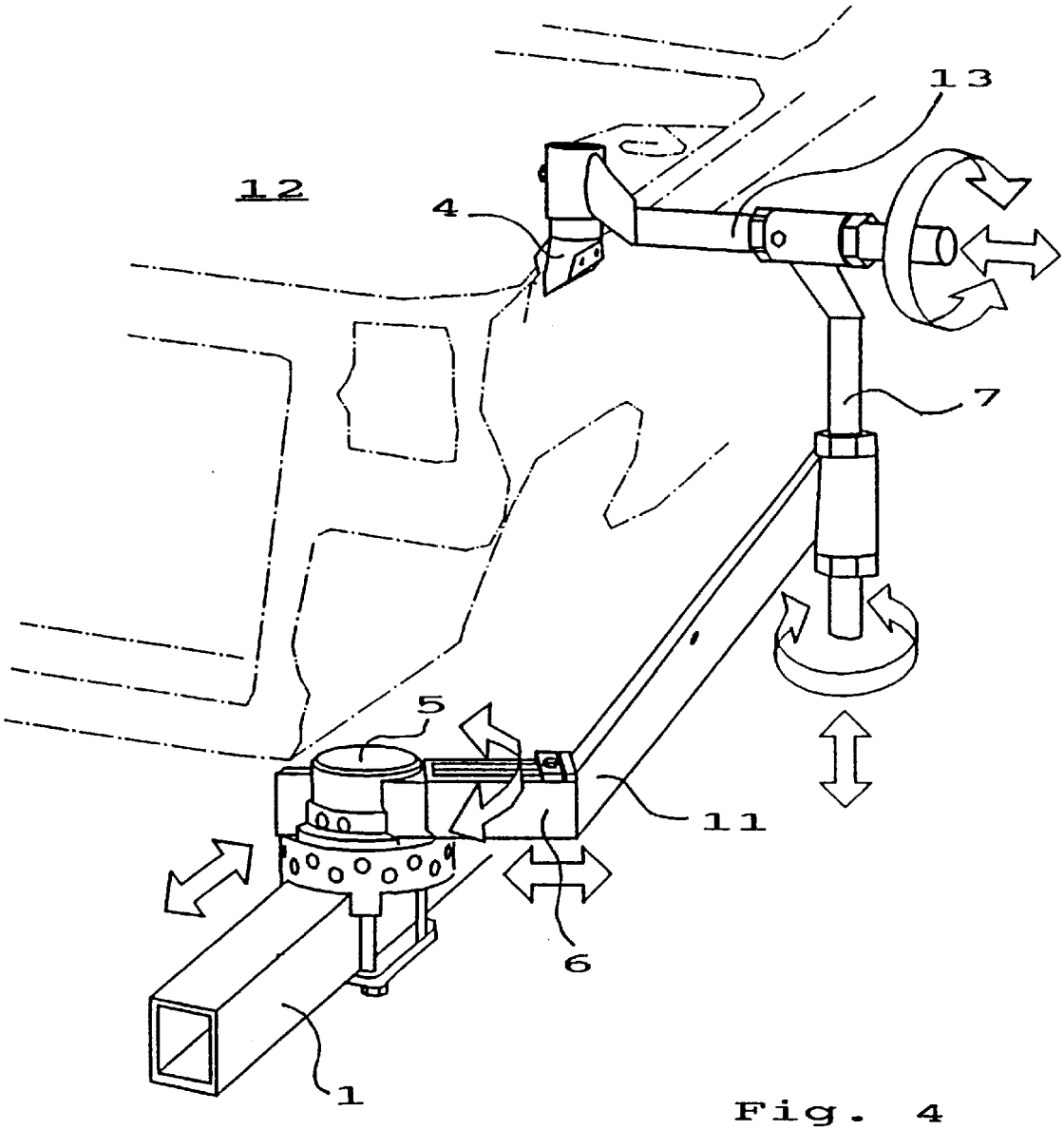

The structure of the device shown in FIG. 4 mainly corresponds to the application shown in FIG. 3. In the application shown in FIG. 4 the device also comprises a diagonally upwards extending heightening arm 11 attached to the arm 6 at the end of which the vertically extending arm 7 is attached.

Figure 5:
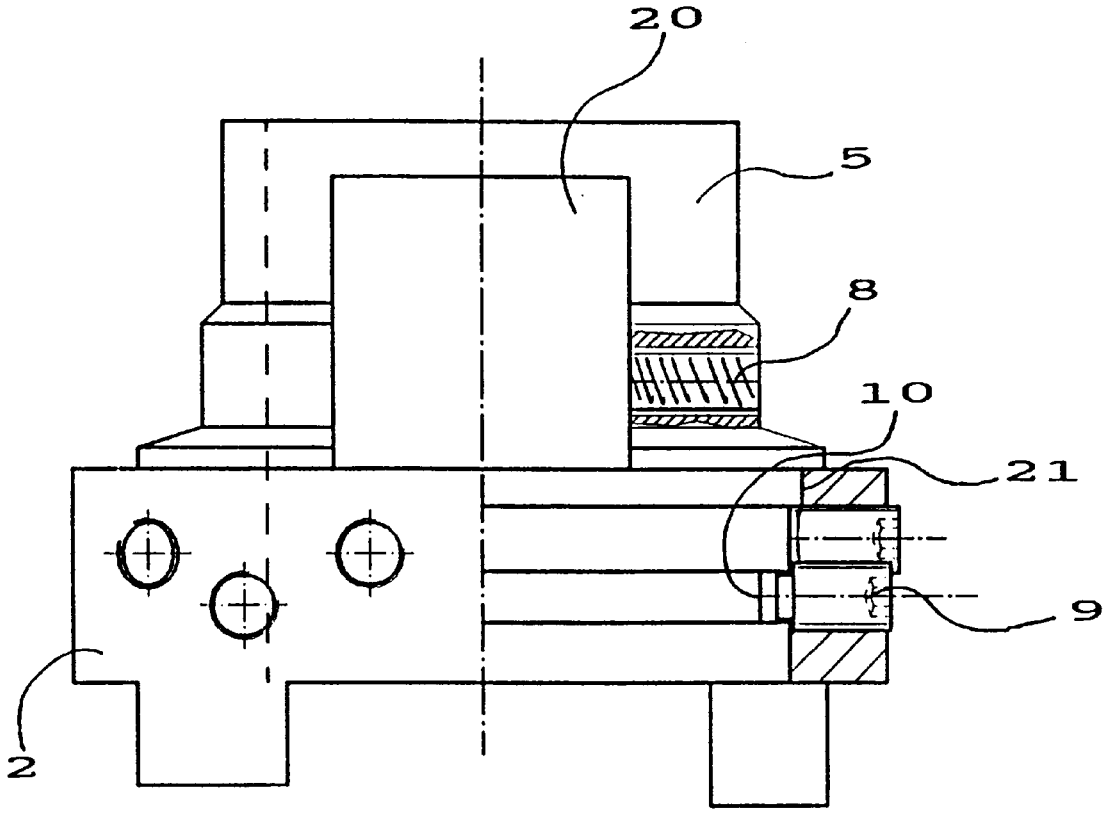
FIG. 5 shows the turning member of the device partly in cross section.

FIG. 5 shows an application of attaching the turning member 5 to the mounting member 2 and attaching the arm to the turning member. The locking screws 8, 9 function as locking members. The mounting member throughout comprises holes at suitable spacings from each other, into which the locking screws 9 are inserted. In this application the holes and the screws are on two planes. The turning member has two bearing surfaces 21 located against the inner surface of the mounting member hole. Between the bearing surfaces there are two round-going grooves 10, on which the locking screws are placed. By tightening the locking screws against the surfaces of the grooves, a steady locking is accomplished. A sufficent and reliable locking is attained by using several screws. Correspondingly, with the help of the locking screws 8, which are situated in the holes made in the turning member frame, the arm 6 is attached to the turning member. The screws used in this application can be varied, e.g., screws with flat or hollow points.

Figure 6:
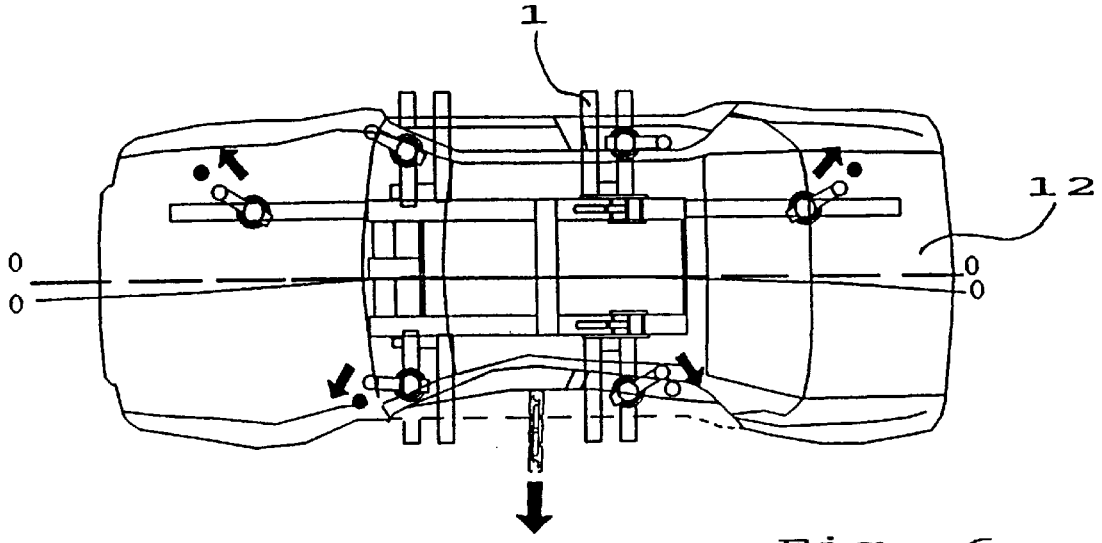
FIGS. 6 and 7 show a certain use of the device according to the invention when straightening the vehicle.
Figure 7:
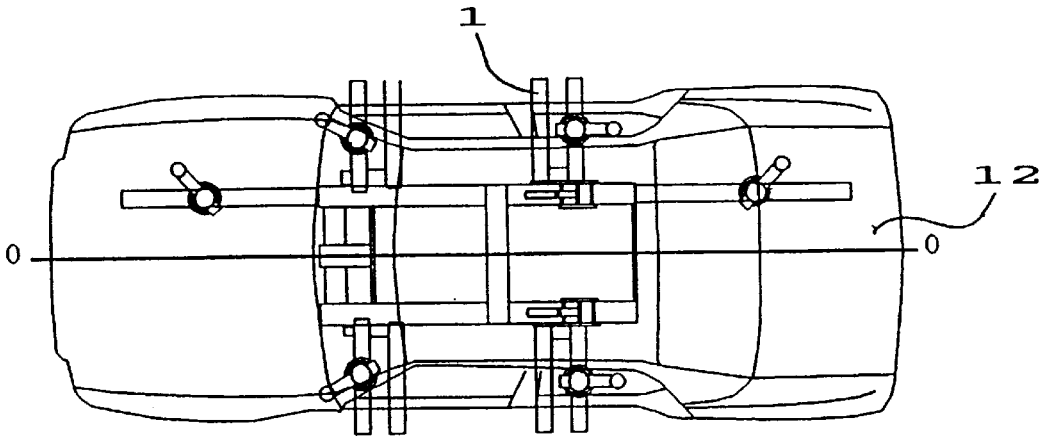

FIG. 6 and 7 show a certain function of positioning devices when straightening the vehicle body. FIG. 6 shows a vehicle body 12 attached to the straightening bed I with the fasteners attached to the positioning devices. When pulling downwards with the pulling member in the manner shown in FIG. 6, the forces of various directions and various magnitude exercise an effect on the mounting points. By placing the positioning devices according to the invention in a suitable way, the fasteners are allowed to turn to a certain direction, which thus enables an effective straightening of the body.

The invention is not limited to the preferred embodiments described above, but rather, can be varied within the scope of the invention defined in the appended claims. The positioning device according to the invention can also be used for purposes other than for straightening a vehicle body.

I claim:

1. A tool positioning device comprising:

a mounting member detachably mounted and lockable to a beam of a straightening system;

a frame turnably attached to said mounting member, said frame comprising a turning member;

said turning member rotatably attached to said mounting member and comprising a portion defining an opening extending from one side of said turning member to an opposite side of said turning member;

an arm adapted to receive a tool arranged to be rotatably installed on said arm, said arm being within the opening of said turning member and movable within said opening along a longitudinal direction of said opening; and arm locking members for mounting said arm into said turning member.

2. The tool positioning device according to claim 1, further comprising:

another arm attached to said arm, said another arm having a length dimension which is adjustable, being lockable into an adjusted lengthwise position, and being adapted to mount said tool.

3. The tool positioning device according to claim 1, wherein said mounting member comprises mounting member locking members spaced from each other for attaching and locking said base frame into said mounting member.

4. The tool positioning device according to claim 3, wherein said arm locking members and said mounting member locking members comprises screw-like members providing a spotwise locking.

5. The positioning device according to claim 3, wherein a surface of said mounting member comprises machined grooves for receiving said mounting member locking members.

6. The tool positioning device according to claim 1, further comprising a heightening arm attached to an end of said arm and extending upwardly from a point at which said heightening arm is attached to said arm.

* * * * *